US007205961B1

(12) United States Patent
Yashiro et al.

(10) Patent No.: US 7,205,961 B1
(45) Date of Patent: Apr. 17, 2007

(54) DISPLAY APPARATUS HAVING UNIFORMITY FUNCTION OF PIXEL LUMINESCENCE FREQUENCY AND DISPLAY METHOD

(75) Inventors: Junichi Yashiro, Tokyo (JP); Makoto Imajou, Tokyo (JP)

(73) Assignee: Pioneer Plasma Display Corporation, Kagoshima Prefecture (JP)

( * ) Notice: Subject to any disclaimer, the term of this patent is extended or adjusted under 35 U.S.C. 154(b) by 321 days.

(21) Appl. No.: 09/612,120

(22) Filed: Jul. 7, 2000

(30) Foreign Application Priority Data

Oct. 18, 1999 (JP) ..... 11-295021

(51) Int. Cl.
*G09G 3/28* (2006.01)

(52) U.S. Cl. ..... 345/60; 345/209

(58) Field of Classification Search ..... 345/60, 345/61, 63, 64, 65, 209, 687; 348/687, 726, 348/727, 800, 572, 573, 790, 793, 792
See application file for complete search history.

(56) References Cited

U.S. PATENT DOCUMENTS 4,722,005 A 1/1988 Ledenbach ..... 358/168
5,287,172 A * 2/1994 Lee ..... 348/518
5,742,122 A * 4/1998 Amemiya et al. ..... 313/582
5,828,356 A * 10/1998 Stoller ..... 345/60
5,838,383 A * 11/1998 Chimoto et al. ..... 348/553
6,288,829 B1 * 9/2001 Kimura ..... 359/291
6,313,818 B1 * 11/2001 Kondo et al. ..... 345/89
6,452,526 B2 * 9/2002 Sagawa et al. ..... 341/144
6,476,801 B2 * 11/2002 Nagai ..... 345/213

FOREIGN PATENT DOCUMENTS

| | | |
|---|---|---|
| DE | 41 42 894 | 12/1991 |
| JP | 03-217190 | 9/1991 |
| JP | 05-244501 | 9/1993 |
| JP | 06-102845 | 4/1994 |
| JP | 08-211858 | 8/1996 |
| JP | 09-050258 | 2/1997 |
| JP | 09-114418 | 5/1997 |
| JP | 2001-067040 | 3/2001 |
| WO | WO 99/46935 | 9/1999 |

* cited by examiner

*Primary Examiner*—Richard Hjerpe
*Assistant Examiner*—Jean Lesperance
(74) *Attorney, Agent, or Firm*—Drinker Biddle & Reath LLP

(57) ABSTRACT

Means for inverting levels of R, G and B signals that are analog signals, and are primary color signals of video signals, in response to an instruction signal for inverting luminance, and means for displaying the above-described inverted video signals are included.

13 Claims, 4 Drawing Sheets

DISPLAY APPARATUS HAVING UNIFORMITY FUNCTION OF PIXEL LUMINESCENCE FREQUENCY AND DISPLAY METHOD

BACKGROUND OF THE INVENTION

The present invention relates to a technology for reducing an aged variation of luminance of a display apparatus, and especially, to a technology capable of reducing luminance deterioration due to an aged variation of a pixel fluorescent material of a plasma display, which selectively emits light.

A prior art will be explained using FIG. 4.

FIG. 4 is a block diagram of a conventional display apparatus.

In FIG. 4, 200 is a display apparatus, which is for displaying a video signal that is input from an outside. The display apparatus 200 is constructed of a video signal demodulating section 201, an RGB signal input section 202, an RGB amplification switch section 203, an A/D converter 204R, an A/D converter 204G, an A/D converter 204B, a digital signal processing section 205, and a plasma panel 206.

Next, operation of the above-mentioned conventional display apparatus 200 will be explained.

The video signal demodulating section 201 demodulates a video signal that has been input to an RGB signal, and outputs it to the RGB amplification switch section 203. Also, in case that a video signal is not a video signal, but an RGB signal, the video signal is input to the RGB signal input section 202. And, the RGB signal input section 202 outputs the RGB signal that has been input, to the RGB amplification switch section 203.

The RGB amplification switch section 203 outputs an R signal out of the RGB signal that has been input from the video signal demodulating section 201 or the RGB signal input section 202, to the A/D converter 204R, and outputs a G signal to the A/D converter 204G, and outputs a B signal to the A/D converter 204B.

The A/D converter 204R applies A/D conversion to the R signal that has been input, and outputs it to the digital signal processing section 205. Also, the A/D converter 204G applies A/D conversion to the G signal that has been input, and outputs it to the digital signal processing section 205. And, the A/D converter 204B applies A/D conversion to the B signal that has been input, and outputs it to the digital signal processing section 205.

The digital signal processing section 205 converts and processes each signal that has been input from the A/D converter 204R, the A/D converter 204G and the A/D converter 204B into a signal that the plasma panel 206 can display, and outputs it to the plasma panel 206.

The plasma panel 206 conducts a display by making a fluorescent material radiate based on the signal input from the digital signal processing section 205.

As mentioned above, the plasma display 206 is for conducting a display by using the fluorescent material as luminescence means. Accordingly, like other fluorescent material display elements, luminescence deterioration of a pixel fluorescent material associated with an aged variation occurs between a pixel that is continuously selected for luminescence and a pixel that is not selected. This is recognized as a luminescence difference phenomenon between the pixels. In other words, this phenomenon is caused by a characteristic of a luminescence phenomenon due to an aged variation of a fluorescent material.

Accordingly, conventionally, as a method of avoiding this phenomenon, a study from a material aspect of a fluorescent material and a discharge gas that are used for the plasma display has been conducted. On the other hand, in a circuit used for the plasma display, a method of reducing a luminescence difference by conducting aging by means of all white signals or a method in which the discharge number per unit time period, which participates in luminescence, is reduced, and a time period until an aged variation appears is elongated has been tried.

However, in the method in which a material aspect of the fluorescent material and the discharge gas used for the plasma display is improved, there is a problem that it requires a long study time and a great study expense.

Also, in the method in which the discharge number per unit time period, which participates in luminescence of the plasma display, is reduced, there is a problem that it is hard to see a display.

Also, in case of inverting a video signal that is input to the display apparatus, there is a problem that an inverted signal has to be generated on a side of a device for generating the video signal, when display software of the video signal is generated.

SUMMARY OF THE INVENTION

The present invention is for solving such tasks, and has the objective that a display apparatus and displaying method applicable to reduce expansion of a luminescence difference of a pixel fluorescent material due to an aged variation.

The above-described objective is solved by a display apparatus having a uniformity function of a pixel luminescence frequency, characterized in that the apparatus comprises:

means for inverting levels of R, G and B signals that are analog signals, and are primary color signals of video signals, in response to an instruction signal for inverting luminance; and means for displaying the above-described inverted video signals. By means of these means, a concentration of luminescence deterioration due to an aged variation to a specific pixel can be reduced.

Also, the above-described objective is solved by a display apparatus having a uniformity function of a pixel luminescence frequency, characterized in that the apparatus comprises:

means for inverting signal logic of R, G and B signals that are digital signals, and are primary color signals of video signals, in response to an instruction signal for inverting luminance; and means for displaying the above-described inverted video signals. The above-described means for inverting the signal logic may be a general inverter, and can be formed of a cheap component.

Moreover, the above-described display apparatus having a uniformity function of a pixel luminescence frequency is characterized by having means for generating the above-described instruction signal for inverting luminance during a preset period of time. By means of this means, the luminance can be inverted during a time band that is not usually used for a display.

Especially, it is characterized that the above-described displaying means is a plasma display.

Furthermore, it is characterized that the above-described plasma display has a plasma panel in which a discharge gas is enclosed and closed between two glass plates, and an inside of the above-described glass plates are partitioned by a partition, and a fluorescent material is applied, and further, a plurality of linear electrodes are set in perpendicular and horizontal directions, and a discharge occurs by selectively applying a voltage to the above-described linear electrodes, and an image is displayed on the above-described plasma display.

Also, it is characterized that an image displayed by the above-described display apparatus having a uniformity function of a pixel luminescence frequency is a still picture, an automatic page still picture or a moving picture that is repeatedly regenerated.

Also, it is characterized that the above-described display apparatus having a uniformity function of a pixel luminescence frequency has means for demodulating the video signals to generate an R signal, a G signal and a B signal that are primary color signals of the video signals.

The above-described objective is solved by a displaying method for displaying an automatic page still picture or a moving picture that is repeatedly regenerated, comprising the steps of:

generating an instruction signal for inverting luminance during a preset period of time inverting levels of R, G and B signals that are analog signals, and are primary color signals of video signals, in response to said instruction signal for inverting luminance; and displaying said inverted video signals.

The above-described objective is solved by a displaying method for displaying an automatic page still picture or a moving picture that is repeatedly regenerated, comprising the steps of:

generating an instruction signal for inverting luminance during a preset period of time inverting signal logic of R, G and B signals that are digital signals, and are primary color signals of video signals, in response to an instruction signal for inverting luminance; and displaying said inverted video signals.

BRIEF DESCRIPTION OF THE INVENTION

This and other objects, features, and advantages of the present invention will become more apparent upon a reading of the following detailed description and drawings, in which.

DESCRIPTION OF THE EMBODIMENTS

A first embodiment of the present invention will be explained using FIG. 1 and FIG. 2.

Figure 1:
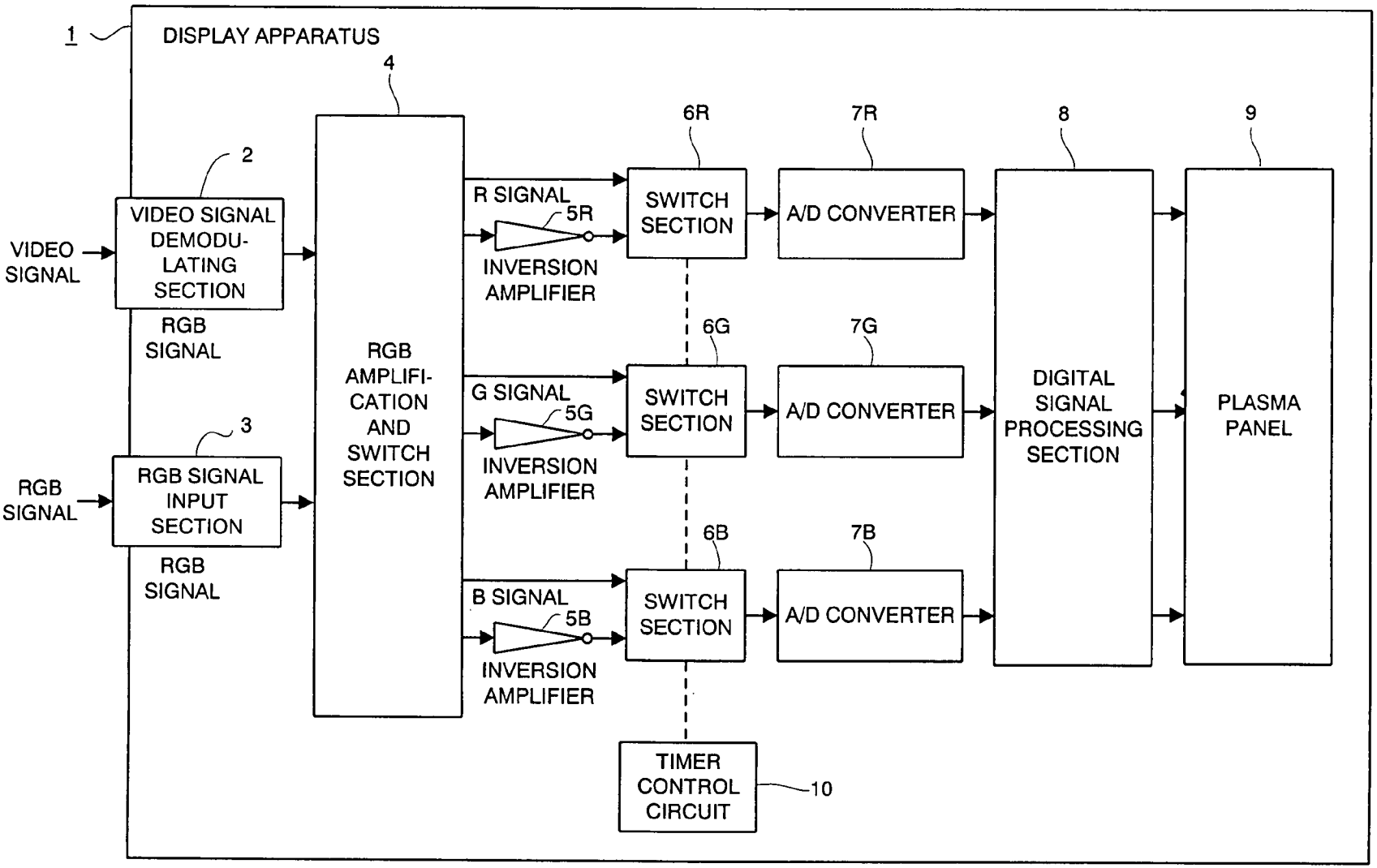
FIG. 1 is an arrangement view of a display apparatus in accordance with a first embodiment related to the present invention.

FIG. 1 is an arrangement view of the first embodiment in accordance with the present invention. FIG. 2 is an example of a screen on which a display apparatus in accordance with the present invention shows an image.

In FIG. 1, 1 is a display apparatus, which is for showing a video signal that is input from a device (a video deck, a personal computer and a television tuner, for example) for generating a video signal. The display apparatus 1 is constructed of a video signal demodulating section 2, to which a video signal is input, an RGB signal input section 3, to which an RGB signal is input, an RGB amplification and switch section 4, an inversion amplifier 5R, an inversion amplifier 5G, an inversion amplifier 5B, a switch section 6R, a switch section 6G, a switch section 6B, an A/D converter 7R, an A/D converter 7G, an A/D converter 7B, a digital signal processing section 8, a plasma panel 9, a timer control circuit 10.

Here, a video signal that is input to the video signal demodulating section 2 is a serial interface video signal in which so called luminance or a color difference is multiplexed. It is a video signal based on an NTSC (National Television System Committee) system, for example. On the other hand, a video signal that is input to the RGB signal input section 3 is an RGB signal such as an R signal (referred to as an R signal, hereinafter) of a primary color signal, a G signal (referred to as a G signal, hereinafter) of a primary color signal, and a B signal (referred to as a B signal, hereinafter) of a primary color signal.

Next, an arrangement of the first embodiment will be explained further in detail.

A video signal is input to the video signal demodulating section 2 from an outside. And, the video signal demodulating section 2 demodulated the input video signal to an RGB signal, and outputs it to the RGB amplification and switch section 4.

An RGB signal is input to the RGB signal input section 3 from an outside. And, the video signal demodulating section 2 outputs the input RGB signal to the RGB amplification and switch section 4.

The RGB signal is input to the RGB amplification and switch section 4 from the video signal demodulating section 2 or the RGB signal input section 3. And, the RGB amplification and switch section 4 outputs an R signal out of the input RGB signal to the inversion amplifier 5R and the switch section 6R. Also, it outputs a G signal out of the input RGB signal to the inversion amplifier 5G and the switch section 6G. Also, it outputs a B signal out of the input RGB signal to the inversion amplifier 5B and the switch section 6B.

The inversion amplifier 5R is for inverting the input R signal and outputting it to the switch section 6R. The inversion amplifier 5R is constructed of an analog OP amplifier, for example. And, in case that the input R signal varies between 0V and 1V, it inverts a level of the R signal assuming that 0.5 is a middle point. Particularly, in case that 0.2V is input, it outputs 0.8V. Also, in case that 0.7V is input, it outputs 0.3V.

The inversion amplifier 5G is for inverting the input G signal and outputting it to the switch section 6G. The inversion amplifier 5G is constructed of an analog OP amplifier, for example. And, in case that the input G signal varies between 0V and 1V, it inverts a level of the G signal assuming that 0.5 is a middle point. Particularly, in case that 0.2V is input, it outputs 0.8V. Also, in case that 0.7V is input, it outputs 0.3V.

The inversion amplifier 5B is for inverting the input B signal and outputting it to the switch section 6B. The inversion amplifier 5B is constructed of an analog OP amplifier, for example. And, in case that the input B signal varies between 0V and 1V, it inverts a level of the B signal assuming that 0.5 is a middle point. Particularly, in case that 0.2V is input, it outputs 0.8V. Also, in case that 0.7V is input, it outputs 0.3V.

The switch section 6R is for switching a signal that is input from the RGB amplification and switch section 4 and a signal that is input from the inversion amplifier 5R to each other, and outputting them to the A/D converter 7R. The switch section 6R is constructed of an analog switch, for example. The switch section 6R is for conducting the switching of the signals in response to an instruction signal for inverting luminance from the timer control circuit 10. Also, the switch section is for conducting the switching of the signals in response to an instruction signal for inverting luminance from a manual switch, although it is not shown in the figures.

The switch section 6G is for switching a signal that is input from the RGB amplification and switch section 4 and a signal that is input from the inversion amplifier 5R to each other, and outputting them to the A/D converter 7G. The switch section 6G is constructed of an analog switch, for example. The switch section 6G is for conducting the switching of the signals in response to the instruction signal from the timer control circuit 10. Also, the switch section is for conducting the switching of the signals in response to the instruction signal from a manual switch, although it is not shown in the figures.

The switch section 6B is for switching a signal that is input from the RGB amplification and switch section 4 and a signal that is input from the inversion amplifier 5B to each other, and outputting them to the A/D converter 7B. The switch section 6B is constructed of an analog switch, for example. The switch section 6B is for conducting the switching of the signals in response to the instruction signal from the timer control circuit 10. Also, the switch section is for conducting the switching of the signals in response to the instruction signal from a manual switch, although it is not shown in the figures.

The A/D converter 7R is for converting an analog signal that is input from the switch section 6R into a digital signal, and outputting it to the digital signal processing section 8.

The A/D converter 7G is for converting an analog signal that is input from the switch section 6G into a digital signal, and outputting it to the digital signal processing section 8.

The A/D converter 7B is for converting an analog signal that is input from the switch section 6B into a digital signal, and outputting it to the digital signal processing section 8.

The digital signal processing section 8 is for converting and processing each signal that is input from the A/D converter 7R, the A/D converter 7G and the A/D converter 7B into a signal that can be displayed by the plasma panel 9, and outputting it to the plasma panel 9.

The plasma panel 9 is for conducting a display by making a fluorescent material radiate based on the signal that is input from the digital signal processing section 8.

The timer control circuit 10 is for outputting an instruction signal for inverting luminance during a preset period of time to the switch section 6R, the switch section 6G and the switch section 6B.

Next, operation of the first embodiment in accordance with the present invention will be explained.

First, in case of displaying a video signal, a video signal is input to the video signal demodulating section 2. The video signal demodulating section 2 converts the input video signal into an RGB signal, and outputs it to the RGB amplification and switch section 4. Also, in case of displaying an RGB signal, an RGB signal is input to the RGB signal input section 3. The RGB signal input section 3 outputs the input video signal into the RGB amplification and switch section 4.

The RGB amplification and switch section 4 outputs an R signal out of the RGB signal that is input from the video signal demodulating section 2 or the RGB signal input section 3, to the inversion amplifier 5R and the switch section 6R. Also, the RGB amplification and switch section 4 outputs a G signal out of the input RGB signal to the inversion amplifier 5G and the switch section 6G. And, the RGB amplification and switch section 4 outputs a B signal out of the input RGB signal to the inversion amplifier 5B and the switch section 6B.

Next, the inversion amplifier 5R inverts a level of the input R signal, and outputs it to the switch section 6R. Also, the inversion amplifier 5G inverts a level of the input G signal, and outputs it to the switch section 6G. And, the inversion amplifier 5B inverts a level of the input B signal, and outputs it to the switch section 6G. In other words, in the present invention, by inverting the R signal, the G signal and the B signal, luminance is inverted.

And, the switch section 6R conducts switching of signals in response to an instruction signal from the timer control circuit 10 or the manual switch (not shown in the figures). Also, the switch section 6G conducts switching of signals in response to an instruction signal from the timer control circuit 10 or the manual switch (not shown in the figures). And, the switch section 6B conducts switching of signals in response to an instruction signal from the timer control circuit 10 or the manual switch (not shown in the figures). In other words, in the display apparatus 1 in accordance with the present invention, luminance is inverted in response to the instruction signal from the timer control circuit 10 or the manual switch (not shown in the figures). Here, the timer control circuit 10 outputs the instruction signal to the switch section 6R, the switch section 6G and the switch section 6B in accordance with a preset schedule.

Next, the A/D converter 7R converts an analog signal that is input from the switch section 6R into a digital signal, and outputs it to the digital signal processing section 8. Also, the A/D converter 7G converts an analog signal that is input from the switch section 6G into a digital signal, and outputs it to the digital signal processing section 8. And, the A/D converter 7B converts an analog signal that is input from the switch section 6B into a digital signal, and outputs it to the digital signal processing section 8.

And, the digital signal processing section 8 converts and processes each signal that is input from the A/D converter 7R, the A/D converter 7G and the A/D converter 7B into a signal that can be displayed by the plasma panel 9, and outputs it to the plasma panel 9.

Finally, the plasma panel 9 conducts a display by making a fluorescent material radiate based on the signal that is input from the digital signal processing section 8.

Here, a display screen of the display apparatus in accordance with the present invention will be explained.

Figure 2:
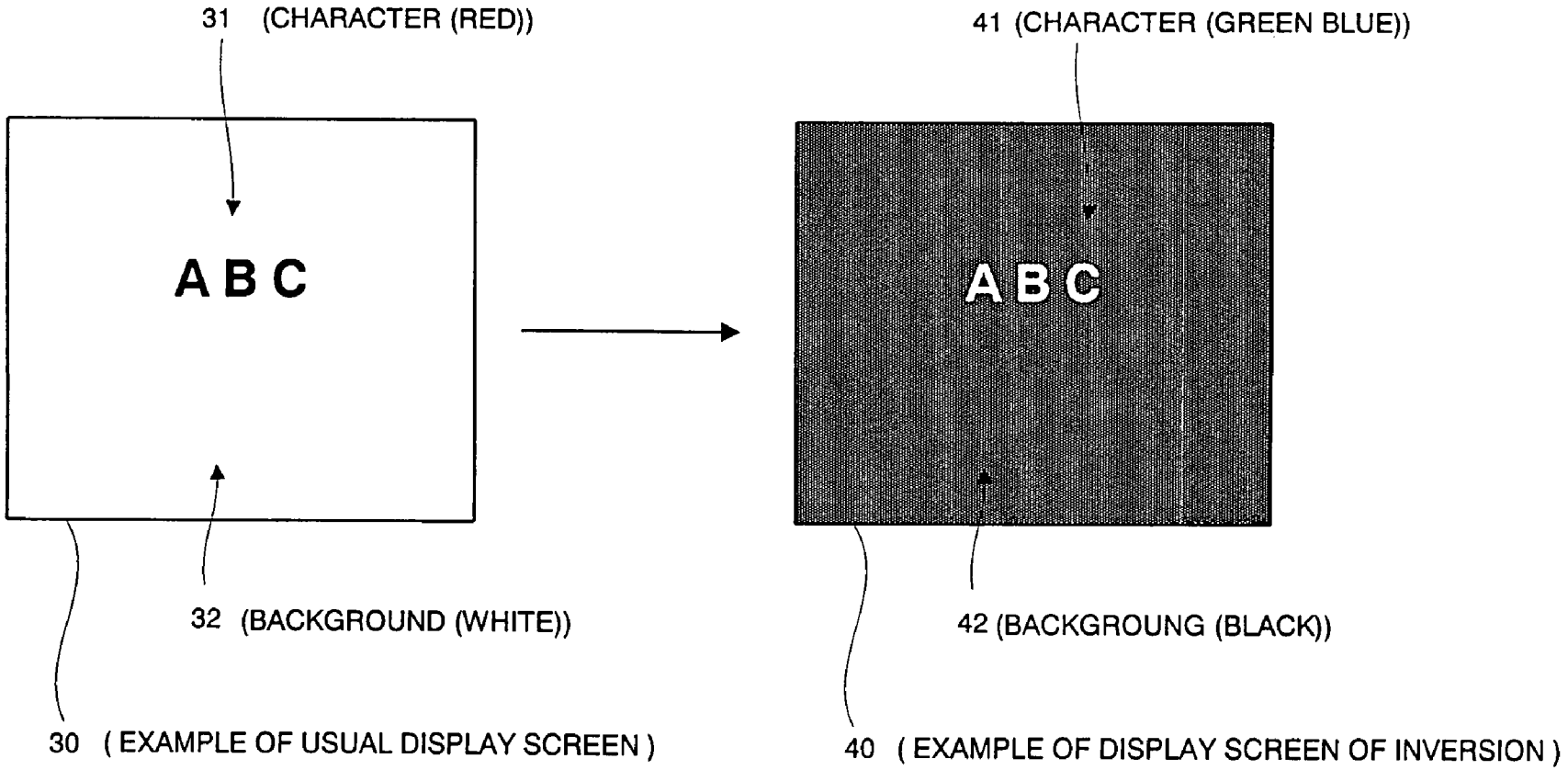
FIG. 2 is a view showing an example of a screen on which a display apparatus related to the present invention shows an image.

In FIG. 2, 30 is an example of a usual display screen. 31 is a character, and is displayed in red. 32 is a background, and is displayed in white. 40 is an example of an inverted display screen, and is condition in which luminance is inverted by means of the present invention. 41 is a character, and is displayed in green blue. 42 is a background, and is displayed in black. In other words, a white part is inverted to black, and a red part is inverted to green blue, respectively. Thereby, uniformity of a luminescence frequency can be promoted.

Next, a second embodiment in accordance with the present invention will be explained using FIG. 3.

In addition, in the explanation of the second embodiment, the explanation of components same as those in the first embodiment will be omitted, and components different from those in the first embodiment will be explained.

In the first embodiment, an arrangement in which the analog inversion amplifiers 5R, 5G and 5B are used is adopted. In the second embodiment, an arrangement in which digital inverters are used is adopted.

Figure 3:
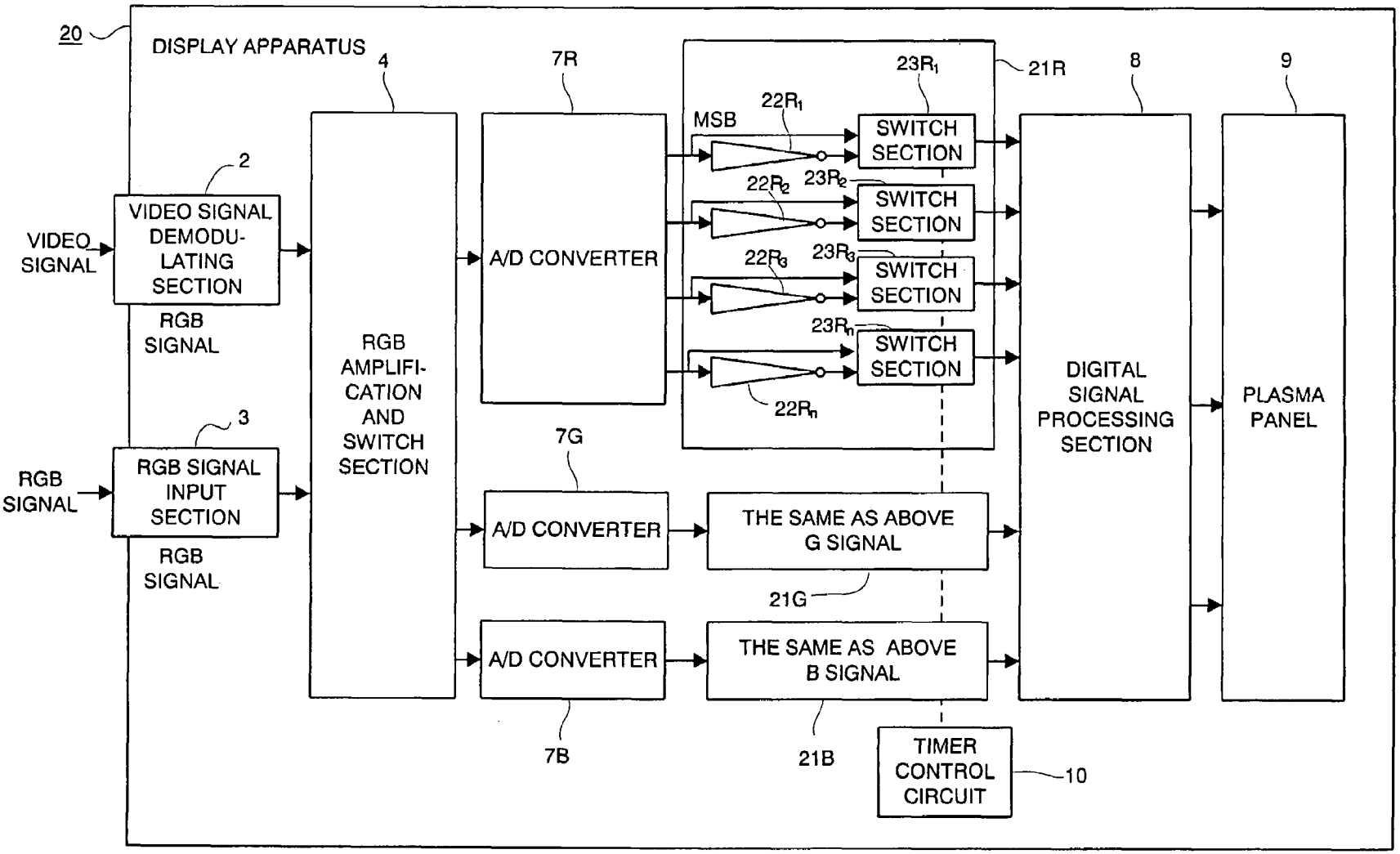
FIG. 3 is an arrangement view of a display apparatus in accordance with a second embodiment related to the present invention and FIG. 4 is an arrangement view of a conventional display apparatus.
Figure 4:
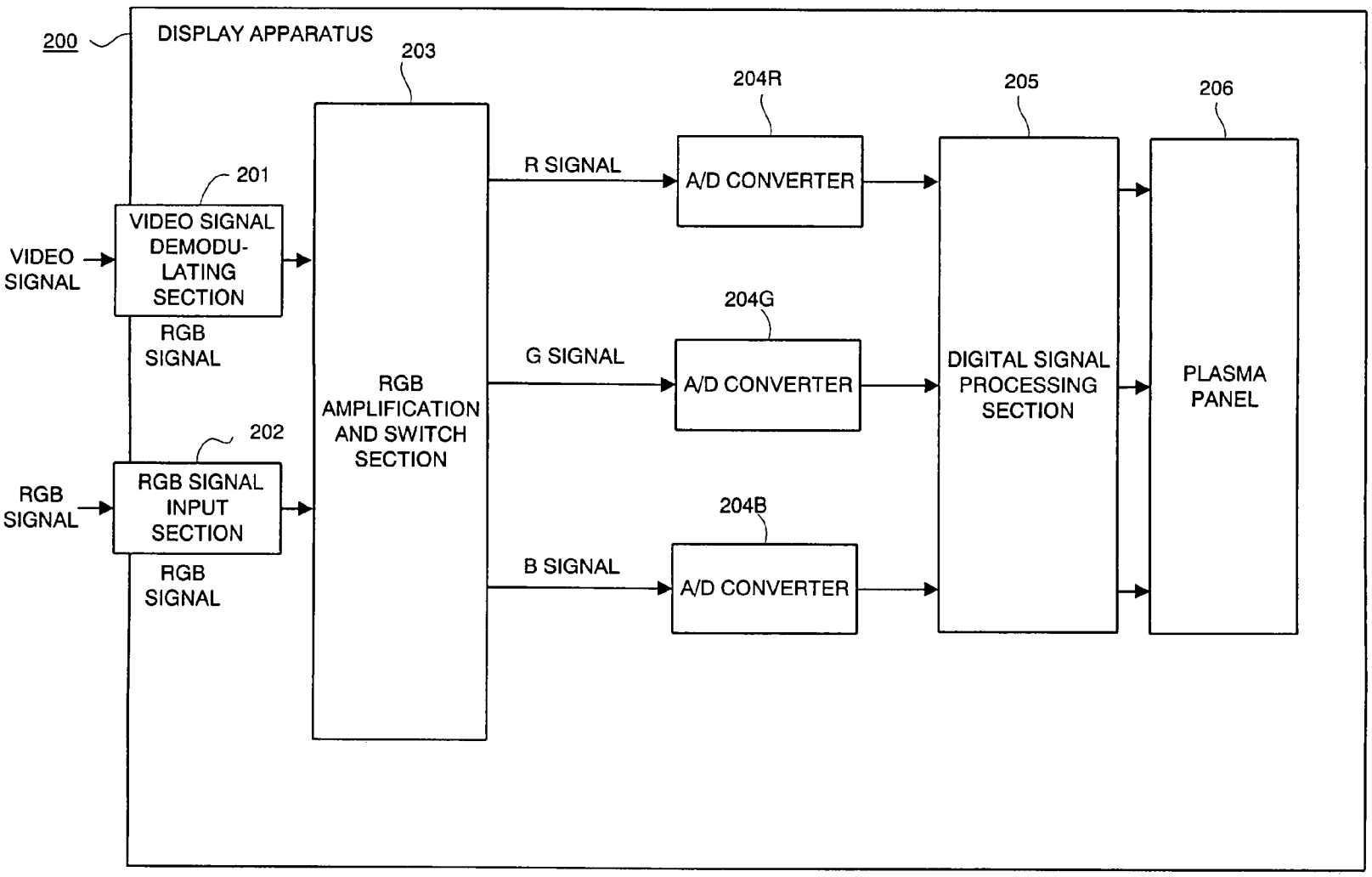
FIG. 4 PRIOR ART

FIG. 3 is an arrangement view of the second embodiment in accordance with the present invention.

In FIG. 3, 20 is and 1 is a display apparatus, which is for showing a video signal that is input from a device (a video deck, a personal computer and a television tuner, for example) for generating a video signal. The display apparatus 20 is constructed of a video signal demodulating section 2, to which a video signal is input, an RGB signal input section 3, to which an RGB signal is input, an RGB amplification and switch section 4, an A/D converter 7R, an A/D converter 7G, an A/D converter 7B, an inversion section 21R, an inversion section 21G, an inversion section 21B, a digital signal processing section 8, a plasma panel 9, a timer control circuit 10.

The inversion section 21R is constructed of an inverter 22$R_1$—an inverter 22$R_n$, and switch sections 23$R_1$–23$R_n$.

The inverter 22$R_1$—the inverter 22$R_n$ are for inverting logic of a digital signal that is input from the A/D converter 7R. In other words, the inverter 22$R_1$—the inverter 22$R_n$ output "0" in case that the input signal is "1", and output "1" in case that the input signal is "0". The inverter 22$R_1$—the inverter 22$R_n$ are constructed of the number of bits that are converted by the A/D converter 7R. For example, in an MSB, the inverter 22$R_1$ is set, and in an LSB, the inverter 22$R_n$ is set.

The switch section 23$R_1$—the switch section 23$R_n$ are for switching a digital signal that is input from the A/D converter 7R and a digital signal that is input from each of the inverter 22$R_1$—the inverter 22$R_n$ to each other in response to an instruction signal from the timer control circuit 10 or a manual switch (not shown in the figures), and outputting them to the digital signal processing section 8.

The inversion section 21G is constructed of an inverter 22$G_1$—an inverter 22$G_n$, and switch sections 23$G_1$–23$G_n$.

The inverter 22$G_1$—the inverter 22$G_n$ are for inverting logic of a digital signal that is input from the A/D converter 7G. In other words, the inverter 22$G_1$—the inverter 22$G_n$ output "0" in case that the input signal is "1", and output "1" in case that the input signal is "0". The inverter 22$G_1$—the inverter 22$G_n$ are constructed of the number of bits that are converted by the A/D converter 7G. For example, in an MSB, the inverter 22$G_1$ is set, and in an LSB, the inverter 22$G_n$ is set.

The switch section 23$G_1$—the switch section 23$G_n$ are for switching a digital signal that is input from the A/D converter 7G and a digital signal that is input from each of the inverter 22$G_1$—the inverter 22$G_n$ to each other in response to an instruction signal from the timer control circuit 10 or the manual switch (not shown in the figures), and outputting them to the digital signal processing section 8.

The inversion section 21B is constructed of an inverter 22$B_1$—an inverter 22$B_n$, and switch sections 23$B_1$–23$B_n$.

The inverter 22$B_1$—the inverter 22$B_n$ are for inverting logic of a digital signal that is input from the A/D converter 7B. In other words, the inverter 22$B_1$—the inverter 22$B_n$ output "0" in case that the input signal is "1", and output "1" in case that the input signal is "0". The inverter 22$B_1$—the inverter 22$B_n$ are constructed of the number of bits that are converted by the A/D converter 7B. For example, in an MSB, the inverter 22$B_1$ is set, and in an LSB, the inverter 22$B_n$ is set.

The switch section 23$B_1$—the switch section 23$B_n$ are for switching a digital signal that is input from the A/D converter 7B and a digital signal that is input from each of the inverter 22$B_1$—the inverter 22$B_n$ to each other in response to an instruction signal from the timer control circuit 10 or the manual switch (not shown in the figures), and outputting them to the digital signal processing section 8.

Next, operation of the second embodiment will be explained.

The RGB amplification and switch section 4 outputs an R signal out of an RGB signal that is input from the video signal demodulating section 2 or the RGB signal input section 3 to the A/D converter 7R. Also, it outputs a G signal out of the RGB signal to the A/D converter 7G. Also, it outputs a B signal out of the RGB signal to the A/D converter 7B.

And, the A/D converter 7R applies digital conversion to the input signal, and outputs the converted signal to the inverter 22$R_1$—the inverter 22$R_n$, and the switch section 23$R_1$—the switch section 23$R_n$. Also, the A/D converter 7G applies digital conversion to the input signal, and outputs the converted signal to the inverter 22$G_1$—the inverter 22$G_n$, and the switch section 23$G_1$—the switch section 23$G_n$. And, the A/D converter 7B applies digital conversion to the input signal, and outputs the converted signal to the inverter 22$B_1$—the inverter 22$B_n$, and the switch section 23$B_1$—the switch section 23$B_n$.

Next, the inverter 22$R_1$—the inverter 22$R_n$ invert logic of the input signal, and output it to the switch section 23$R_1$—the switch section 23$R_n$. Also, the inverter 22$G_1$—the inverter 22$G_n$ invert logic of the input signal, and output it to the switch section 23$G_1$—the switch section 23$G_n$. And, the inverter 22$B_1$—the inverter 22$B_n$ invert logic of the input signal, and output it to the switch section 23$B_1$—the switch section 23$B_n$.

And, the switch section 23$R_1$—the switch section 23$R_n$ conduct switching of the signals in response to an instruction signal from the timer control circuit 10 or the manual switch (not shown in the figures). Also, the switch section 23$G_1$—the switch section 23$G_n$ conduct switching of the signals in response to an instruction signal from the timer control circuit 10 or the manual switch (not shown in the figures). And, the switch section 23$B_1$—the switch section 23$B_n$ conduct switching of the signals in response to an instruction signal from the timer control circuit 10 or the manual switch (not shown in the figures). In other words, in the display apparatus 1 in accordance with the present invention, luminance is inverted in response to the instruction signal from the timer control circuit 10 or the manual switch (not shown in the figures).

And, the digital signal processing section 8 converts and processes each signal that is input from the switch section 23$R_1$—the switch section 23$R_n$, the switch section 23$G_1$—the switch section 23$G_n$ and the switch section 23$B_1$—the switch section 23$B_n$ into a signal that can be displayed by the plasma panel 9, and outputs it to the plasma panel 9.

Finally, the plasma panel 9 conducts a display by making a fluorescent material radiate based on the signal that is input from the digital signal processing section 8.

In addition, an image displayed by the display apparatus 1 and the display apparatus 20 in accordance with the present invention may be a still picture, and may be a moving picture. For example, it may be an automatic page still picture in which a predetermined number of still pictures are repeatedly regenerated. Also, it may be a moving picture that is repeatedly regenerated for a predetermined period of time.

As explained above, in accordance with the present invention, in the same video signal (for example, a still picture) or a video signal in which a luminance distribution having the same tendency is repeatedly input, by replacing a pixel having a high luminescence frequency with a pixel having a low luminescence frequency, and displaying them, it is possible to reduce expansion of a luminescence difference of a pixel fluorescent material due to an aged variation.

Also, in accordance with the present invention, it is possible to reduce expansion of a luminescence difference of a pixel fluorescent material due to an aged variation, without entirely changing a side of a device for generating a video signal.

Further, by means of the timer control circuit in accordance with the present invention, luminance is inverted during a time band that is not usually used for a display, and a usual display can be conducted without inverting the luminance in usual use.

What is claimed is:

1. A display apparatus having a uniformity function of a pixel luminescence frequency, comprising:

a demodulator for demodulating an analog input video signal having a synchronizing component and a signal component into analog R, G and B video signals that are primary color signals of the analog input video signal;

an inverter for inverting only levels of the analog R, G and B video signals representing at least one picture displayed on an entire display screen for inverting luminance to generate inverted analog R, G and B video signals representing at least one luminance inverted picture displayed on an entire display screen, without inverting the synchronizing component of said analog input video signal;

a switch for receiving both of the analog R, G and B video signals from said demodulator and the inverted analog R, G and B video signals from said inverter, and for selecting either the analog R, G and B video signals or the inverted analog R, G and B video signals on a display screen-by-display screen basis in response to an instruction signal so that the entire display screen is inverted when switched between the analog R, G and B video signals and the inverted analog R, G and B video signals, thereby reducing aged variation of luminance of a pixel fluorescent material;

a generator for generating said instruction signal;

a converter for receiving and converting the selected video signals from said switch into digital R, G and B video signals; and a plasma display for displaying said digital R, G and B video signals.

2. A display apparatus having a uniformity function of a pixel luminescence frequency recited in claim 1, wherein a picture displayed by said display apparatus having a uniformity function of a pixel luminescence frequency is a still picture, an automatic page still picture or a moving picture that is repeatedly generated.

3. A display apparatus as claimed in claim 1, wherein a relationship between said input video signal and an inverted signal obtained from inverting said input video signal is defined such that the sum of the amplitude value of said input video signal and said inverted signal is substantially equal to the maximum variable value of the amplitude of said input video signal.

4. A display apparatus having a uniformity function of a pixel luminescence frequency, comprising:

an inverter for inverting levels of analog R, G and B video signals that are primary color signals representing at least one picture displayed on an entire display screen for inverting luminance to generate inverted analog R, G and B video signals representing at least one luminance inverted picture displayed on an entire display screen;

a switch for selecting either the analog R, G and B video signals or the inverted analog R, G and B video signals on a display screen-by-display screen basis in response to an instruction signal to output the selected video signals so that the entire display screen is inverted when switched between the analog R, G and B video signals and the inverted analog R, G and B video signals, thereby reducing aged variation of luminance of a pixel fluorescent material;

a converter for receiving and converting the selected video signals from said switch into digital R, G and B video signals; and a plasma display for displaying said digital R, G and B video signals; and a generator for generating said instruction signal, wherein said plasma display includes a plasma panel having:

two glass plates;

a discharge gas enclosed between said two glass plates, an inside of said glass plates being partitioned by a partition;

a fluorescent material applied to said inside; and a plurality of linear electrodes extending in perpendicular and horizontal directions, wherein a discharge occurs by selectively applying a voltage to said linear electrodes thereby to display a picture on said plasma display.

5. A display apparatus having a uniformity function of a pixel luminescence frequency, said display apparatus displaying an automatic page still picture or a moving picture that is repeatedly regenerated, comprising:

a generator for generating an instruction signal during a preset period of time;

a demodulator for demodulating an analog input video signal having a synchronizing component and a signal component into analog R, G and B video signals that are primary color signals of the analog input video signal;

an inverter for inverting only levels of the analog R, G and B video signals representing at least one picture displayed on an entire display screen for inverting luminance to generate inverted analog R, G and B video signals representing at least one luminance inverted picture displayed on an entire display screen, without inverting the synchronizing component of said analog video signal;

a switch for receiving both of the analog R, G and B video signals from said demodulator and the inverted analog R, G and B video signals from said inverter, and for selecting either the analog R, G and B video signals or the inverted analog R, G and B video signals on a display screen-by-display screen basis in response to said instruction signal so that the entire display screen is inverted when switched between the analog R, G and B video signals and the inverted analog R, G and B video signals, thereby reducing aged variation of luminance of a pixel fluorescent material;

a converter for receiving and converting the selected video signals from said switch into digital R, G and B video signals; and a plasma display for displaying said digital R, G and B video signals.

6. A display apparatus having a uniformity function of a pixel luminescence frequency, said display apparatus displaying an automatic page still picture or a moving picture that is repeatedly regenerated, comprising:

a generator for generating an instruction signal during a preset period of time;

an inverter for inverting levels of analog R, G and B video signals that are primary color signals representing at least one picture displayed on an entire display screen for inverting luminance to generate inverted analog R, G and B video signals representing at least one luminance inverted picture displayed on an entire display screen;

a switch for selecting either the analog R, G and B video signals or the inverted analog R, G and B video signals on a display screen-by-display screen basis in response to said instruction signal so that the entire display screen is inverted when switched between the analog R, G and B video signals and the inverted analog R, G and B video signals, thereby reducing aged variation of luminance of a pixel fluorescent material;

a converter for receiving and converting the selected video signals from said switch into digital R, G and B video signals; and a plasma display for displaying said digital R, G and B video signals, wherein said plasma display includes a plasma panel having:

two glass plates;

a discharge gas enclosed between said two glass plates, an inside of said glass plates being partitioned by a partition;

a fluorescent material applied to said inside; and a plurality of linear electrodes extending in perpendicular and horizontal directions, wherein a discharge occurs by selectively applying a voltage to said linear electrodes thereby to display a picture on said plasma display.

7. A display apparatus having a uniformity function of a pixel luminescence frequency, comprising:

a demodulator for demodulating an analog video signal into analog R, G and B video signals that are primary color signals of the analog video signal;

a converter for converting said analog R, G and B video signals into digital R, G and B video signals;

an inverter for inverting levels of said digital R, G and B video signals representing at least one picture displayed on an entire display screen for inverting luminance to generate inverted digital R, G and B video signals representing at least one luminance inverted picture displayed on an entire display screen;

a switch for receiving both of the digital R, G and B video signals from said converter and the inverted digital R, G and B video signals from said inverter, and for selecting either the digital R, G and B video signals or the inverted digital R, G and B video signals on a display screen-by-display screen basis in response to an instruction signal so that the entire display screen is inverted when switched between the digital R, G and B video signals and the inverted digital R, G and B video signals, thereby reducing aged variation of luminance of a pixel fluorescent material;

a generator for generating said instruction signal; and a plasma display for displaying either said digital R, G and B video signals or the inverted digital R, G and B video signals from said switch.

8. A display apparatus having a uniformity function of a pixel luminescence frequency recited in claim 7, wherein a picture displayed by said display apparatus having a uniformity function of a pixel luminescence frequency is a still picture, an automatic page still picture or a moving picture that is repeatedly regenerated.

9. A display apparatus having a uniformity function of a pixel luminescence frequency, comprising:

an inverter for inverting signal logic of digital R, G and B video signals that are primary color signals of video signals representing at least one picture displayed on an entire display screen for inverting luminance to generate inverted digital R, G and B video signals representing at least one luminance inverted picture displayed on an entire display screen;

a switch for selecting either the digital R, G and B video signals or the inverted digital R, G and B video signals on a display screen-by-display screen basis in response to an instruction signal so that the entire display screen is inverted when switched between the digital R, G and B video signals and the inverted digital R, G and B video signals, thereby reducing aged variation of luminance of a pixel fluorescent material; and a plasma display for displaying the selected video signals from said switch, wherein said plasma display includes a plasma panel having:

two glass plates:

a discharge gas enclosed between said two glass plates, an inside of said glass plates being partitioned by a partition;

a fluorescent material applied to said inside; and a plurality of linear electrodes extending in perpendicular and horizontal directions, wherein a discharge occurs by selectively applying a voltage to said linear electrodes thereby to display a picture on said plasma panel.

10. A display apparatus having a uniformity function of a pixel luminescence frequency, said display apparatus displaying an automatic page still picture or a moving picture that is repeatedly regenerated, comprising:

a generator for generating an instruction signal during a preset period of time;

a demodulator for demodulating an analog video signal into analog R, G and B video signals that are primary color signals of the analog video signal;

a converter for converting said analog R, G and B video signals into digital R, G and B video signals;

an inverter for inverting levels of said digital R, G and B video signals representing at least one picture displayed on an entire display screen for inverting luminance to generate inverted digital R, G and B video signals representing at least one luminance inverted picture displayed on an entire display screen;

a switch for receiving both of digital R, G and B video signals from said converter and the inverted digital R, G and B video signals from said inverter, and for selecting either the digital R, G and B video signals or the inverted digital R, G and B video signals on a display screen-by-display screen basis in response to said instruction signal so that the entire display screen is inverted when switched between the digital R, G and B video signals and the inverted digital R, G and B video signals, thereby reducing aged variation of luminance of a pixel fluorescent material; and a plasma display for displaying either said digital R, G and B video signals or the inverted digital R, G and B video signals from said switch.

11. A display apparatus having a uniformity function of a pixel luminescence frequency, said display apparatus displaying an automatic page still picture or a moving picture that is repeatedly regenerated, comprising:

a generator for generating an instruction signal during a preset period of time;

an inverter for inverting signal logic of digital R, G and B video signals that are primary color signals of video signals representing at least one picture displayed on an entire display screen, for inverting luminance to generate inverted digital R, G and B video signals representing at least one luminance inverted picture displayed on an entire display screen;

a switch for selecting either the digital R, G and B video signals or the inverted digital R, G and B video signals on a display screen-by-display screen basis in response to said instruction signal so that the entire display screen is inverted when switched between the digital R, G and B video signals and the inverted digital R, G and B video signals thereby reducing aged variation of luminance of a pixel fluorescent material; and a plasma display for displaying the selected video signals from said switch;

wherein said plasma display includes a plasma panel having:

two glass plates;

a discharge gas enclosed between said two glass plates, an inside of said glass plates being partitioned by a partition;

a fluorescent material applied to said inside; and a plurality of linear electrodes extending in perpendicular and horizontal directions, wherein a discharge occurs by selectively applying a voltage to said linear electrodes thereby to display a picture on said plasma display.

12. A displaying method for displaying on a plasma display an automatic page still picture or a moving picture that is repeatedly regenerated, comprising the steps of:

generating an instruction signal during a preset period of time;

demodulating an analog input video signal having a synchronizing component and a signal component into analog R, G and B video signals that are primary color signals of the analog input video signal;

inverting only levels of the analog R, G and B video signals representing at least one picture displayed on an entire display screen for inverting luminance to generate inverted analog R, G and B video signals representing at least one luminance inverted picture displayed on an entire display screen, without inverting the synchronizing component of said analog video signal;

receiving both of the analog R, G and B video signals and the inverted analog R, G and B video signals;

selecting either the analog R, G and B video signals or the inverted analog R, G and B video signals on a display screen-by-display screen basis in response to said instruction signal so that the entire display screen is inverted when switched between the analog R, G and B video signals and the inverted analog R, G and B video signals, thereby reducing aged variation of luminance of a pixel fluorescent material;

converting the selected analog video signals into digital video signals; and displaying said digital video signals on said plasma display.

13. A displaying method for displaying on a plasma display an automatic page still picture or a moving picture that is repeatedly regenerated, comprising the steps of:

generating an instruction signal during a preset period of time;

demodulating an analog input video signal into analog R, G and B video signals that are primary color signals of the analog input video signal;

converting said analog R, G and B video signals into digital R, G and B video signals;

inverting signal logic of the digital R, G and B video signals representing at least one picture displayed on an entire display screen for inverting luminance to generate inverted digital R, G and B video signals representing at least one luminance inverted picture displayed on an entire display screen;

selecting either the digital R, G and B video signals or the inverted digital R, G and B video signals on a display screen-by-display screen basis in response to said instruction signal so that the entire display screen is inverted when switched between the digital R, G and B video signals and the inverted digital R, G and B video signals, thereby reducing aged variation of luminance of a pixel fluorescent material; and displaying the selected video signals on said plasma display.

* * * * *